United States Patent [19]

Hansell, III

[11] Patent Number: 5,032,089

[45] Date of Patent: Jul. 16, 1991

[54] SHIELDED CONNECTORS FOR SHIELDED CABLES

[75] Inventor: George A. Hansell, III, Newark, Del.

[73] Assignee: W. L. Gore & Associates, Inc., Newark, Del.

[21] Appl. No.: 534,596

[22] Filed: Jun. 6, 1990

[51] Int. Cl.[5] ..... H01R 13/00

[52] U.S. Cl. ..... 439/609

[58] Field of Search ..... 439/497, 607-610

[56] References Cited

U.S. PATENT DOCUMENTS

| | | | |
|---|---|---|---|
| 3,680,033 | 7/1972 | Kawai | 439/609 |
| 4,486,059 | 12/1984 | DeYoung | 439/609 |
| 4,508,415 | 4/1985 | Bunnell . | |
| 4,655,518 | 4/1987 | Johnson et al. | 439/609 |
| 4,662,700 | 5/1987 | Markham . | |
| 4,773,878 | 9/1988 | Hansell, III . | |
| 4,925,400 | 5/1990 | Blair et al. | 439/609 |

FOREIGN PATENT DOCUMENTS

| | | |
|---|---|---|
| 2066671 | of 1971 | France . |
| 2098412 | 11/1982 | United Kingdom . |

*Primary Examiner*—Joseph H. McGlynn
*Attorney, Agent, or Firm*—Dena Meyer Weker

[57] ABSTRACT

This invention relates to connectors for a plurality of shielded cables with matching spacing configurations between signal conductors and connector sockets thus allowing easy termination of higher density cables for high speed electronic signals. Shielded ground conductors are attached to the housing shells of the connector.

10 Claims, 4 Drawing Sheets

SHIELDED CONNECTORS FOR SHIELDED CABLES

FIELD OF THE INVENTION

This invention relates to connectors for groups of shielded cables with controlled spacings between signal conductors of the shielded cables and where additional conductors are used as ground conductors thus allowing for easy termination. Ground conductors are commonly attached to the housing shells of the connector; signal conductors are attached directly to individual sockets.

BACKGROUND OF THE INVENTION

Miniaturization in the electronics industry, in addition to an ever-growing number of elements which can be placed on a circuit chip has generated a need for interconnection techniques that are also miniaturized. In addition to the miniaturization and increased quantity of elements to be interconnected, higher speed circuits require improved electrical properties of the interconnecting means. To satisfy these needs, precision miniaturized coaxial cables have been developed. A connector in the simplest terms is a device used to provide rapid, efficient, connect-disconnect service for electrical wire and cable termination. Connectors also require to be improved to handle these miniaturized coaxial cables.

Improvements to create higher quality cable assemblies for higher speed electronics have focused on coaxial cables in which the overall diameter has been reduced. Existing technology provides coaxial cables having an individual ground associated with each signal conductor that is generally terminated in a manner in which shield integrity is maintained throughout the connector.

U.S. Pat. No. 4,773,878 describes a connector for flat cables with minute spacings between conductors, where alternate conductors are used as signal conductors and ground conductors. The ground conductors are attached directly to the shell of the connector and the signal conductors are attached to signal contacts of the socket assembly thus allowing use of higher density cables for high speed electronic signals.

A shielded cable is a cable comprising one or more individual insulated signal conductors surrounded by a conductive shield which makes at least intermittent contact with one or more ground conductors wherein the entire cable assembly is surrounded by an insulating jacket. A plurality of shielded cables may be assembled to form a shielded flat cable.

There is a need for shielded connectors capable of handling a plurality of shielded cables that provides easy and efficient termination with reasonable density and simultaneously maintains high electrical signal quality.

SUMMARY OF THE INVENTION

The present invention provides connector assemblies having prearranged spacing configurations and provides for ground conductor attachment between cable shields and housing shells allowing for the use of higher fidelity cables for high speed electronics.

The electrical connector for a plurality or group of shielded cables comprises a movable connector section having a socket assembly with at least one row of regularly spaced signal contacts, a plurality of shielded cables comprising signal conductors and ground conductors which contact the shields with a spacing arrangement so that the ground conductors are attached to the ground shell and the signal conductors are affixed to the socket assembly by joining to the socket tails, a shell enclosing the movable connector and a fixed connector section comprising an insulated housing having at least one row of mating contacts and at least one row of springy fingers. The fixed connector section is affixed to the movable connector section by means of mating contacts to sockets. A second row of spaced socket tails and mating contacts may be provided. The present invention provides a capability of increased signal fidelity in a reduced area for a plurality of shielded cables.

DETAILED DESCRIPTION OF THE INVENTION

This invention relates to shielded cable connector assemblies which have prearranged regular spacing configurations and ground conductor attachment to housing shells thus allowing for the use of higher fidelity shielded cables for high speed electronics. The spacing arrangements allow for miniaturization and the ability to increase the number of elements to be interconnected without compromising electrical properties. The shielded cables preserve the electrical signal quality the entire length of the cable between connector parts.

Figure 1:
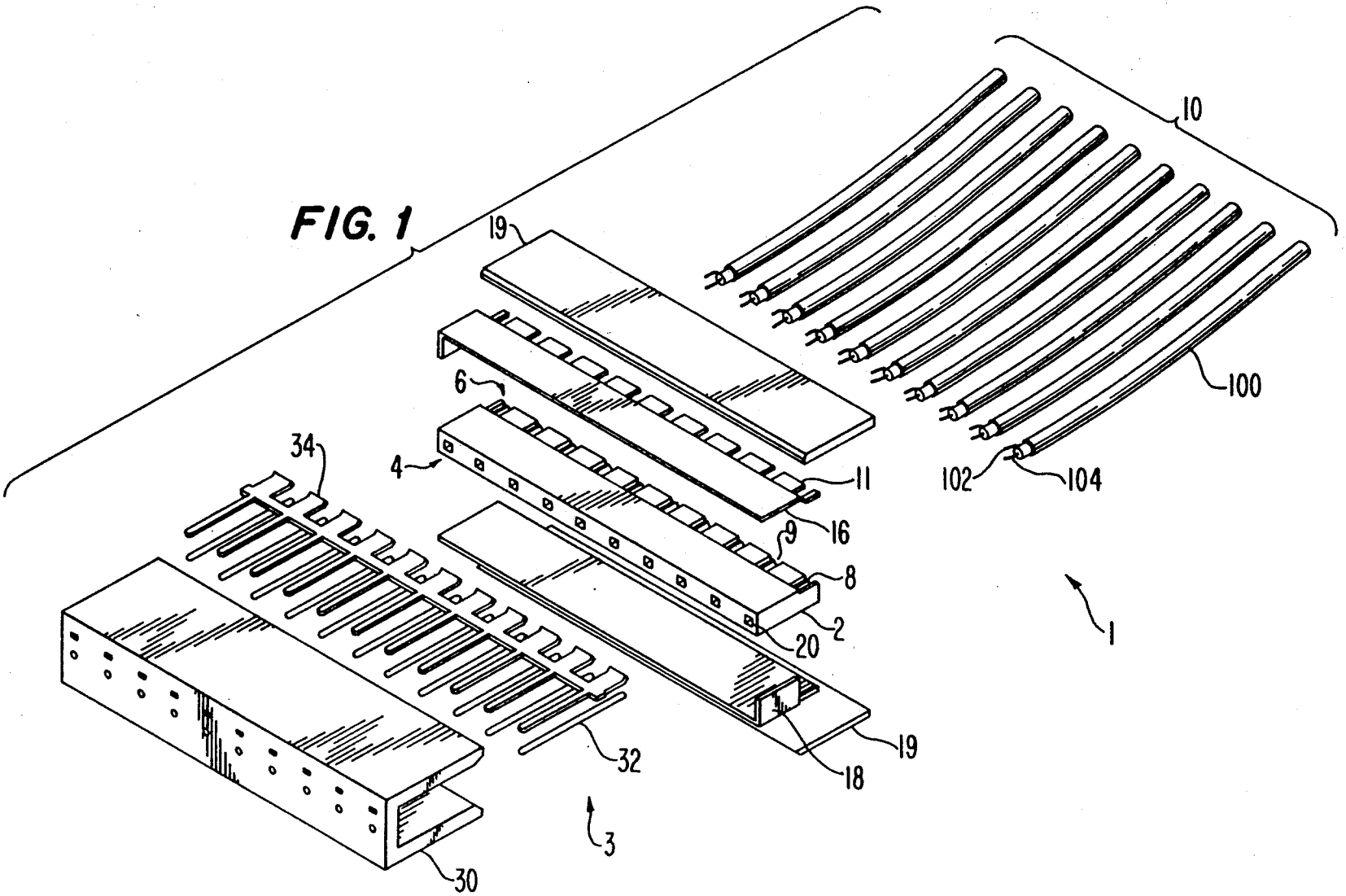
FIG. 1 shows an exploded view of a plurality of shielded cables and connector sections.

The invention is best understood by reference to the accompanying drawings. FIG. 1 shows an exploded view of a movable connector half 1. Also shown in FIG. 1 is a plurality of shielded cables 10. Each shielded cable 100 comprises a shielded conductor 104 in side-by-side parallel relationship to ground conductor 102.

Other cables comprising different combinations of a plurality of signal conductors and ground conductors within a shield are also within the scope of this invention although not illustrated.

The movable connector half 1 is further comprised of a socket assembly 2, grounding shells 16 and 18 so that each shielded cable 100 is affixed to a socket 20 and shell 16 in a prearranged spacing configuration.

The socket assembly 2 is a plastic housing having two faces, namely, front face 4 and rear face 6. A row of sockets 20 are accessible from the front face 4 and the tail end of these sockets 8 are located within slots 9 near the rear face 6 of the assembly. The preferable centerline spacing of the signal socket tails 8 is 2 mm.

An upper half of the grounding shell 16 has slots 11 that correspond to slots 9 of the socket assembly 2 so that when the two parts are fitted snugly together the slots align allowing access to the tail ends of the sockets 8. Ground conductors 102 of each shielded cable 100 are affixed to grounding shell 16.

Figure 2:
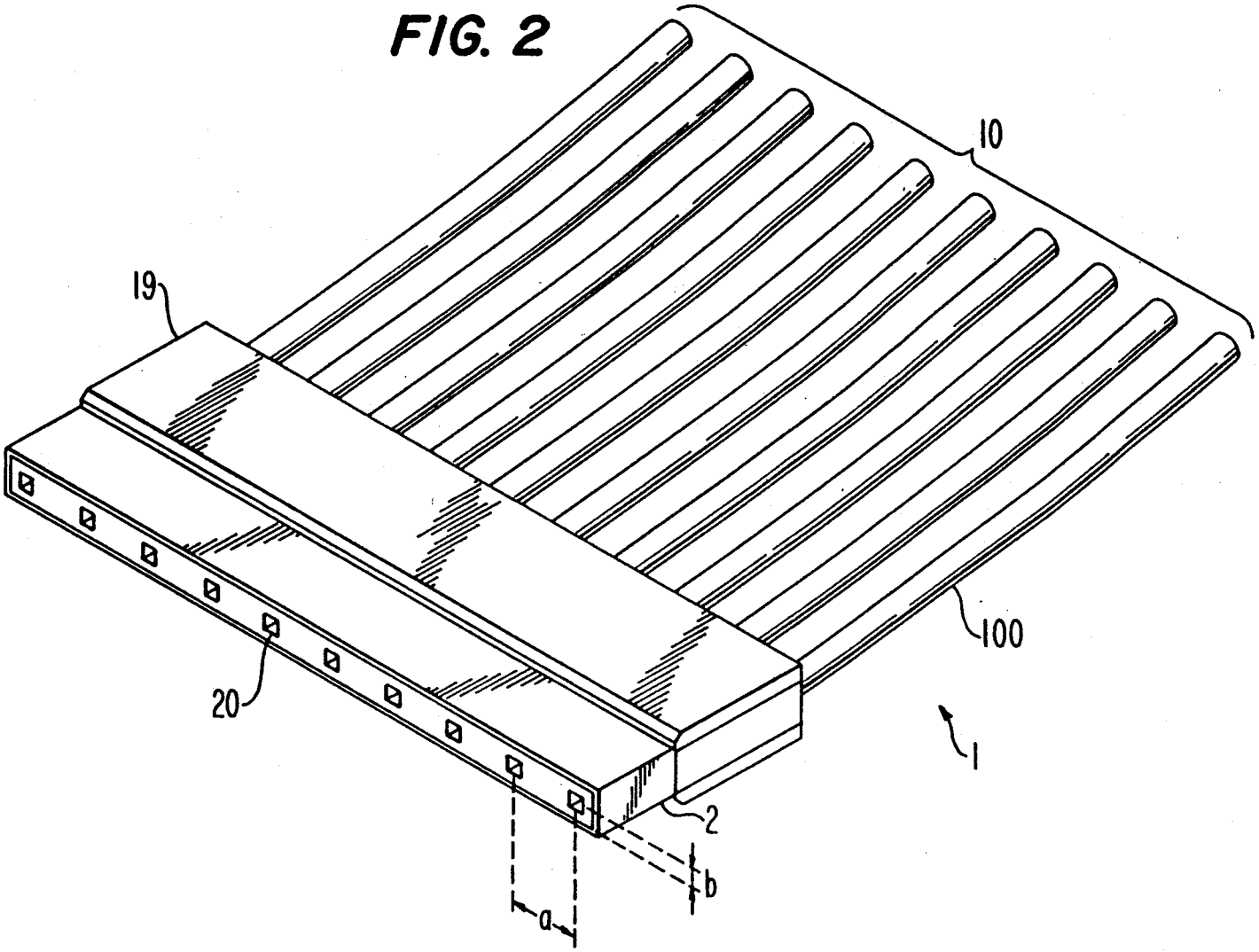
FIG. 2 shows an assembled movable connector half and a plurality of shielded cables with preferred spacing arrangement.
Figure 4:
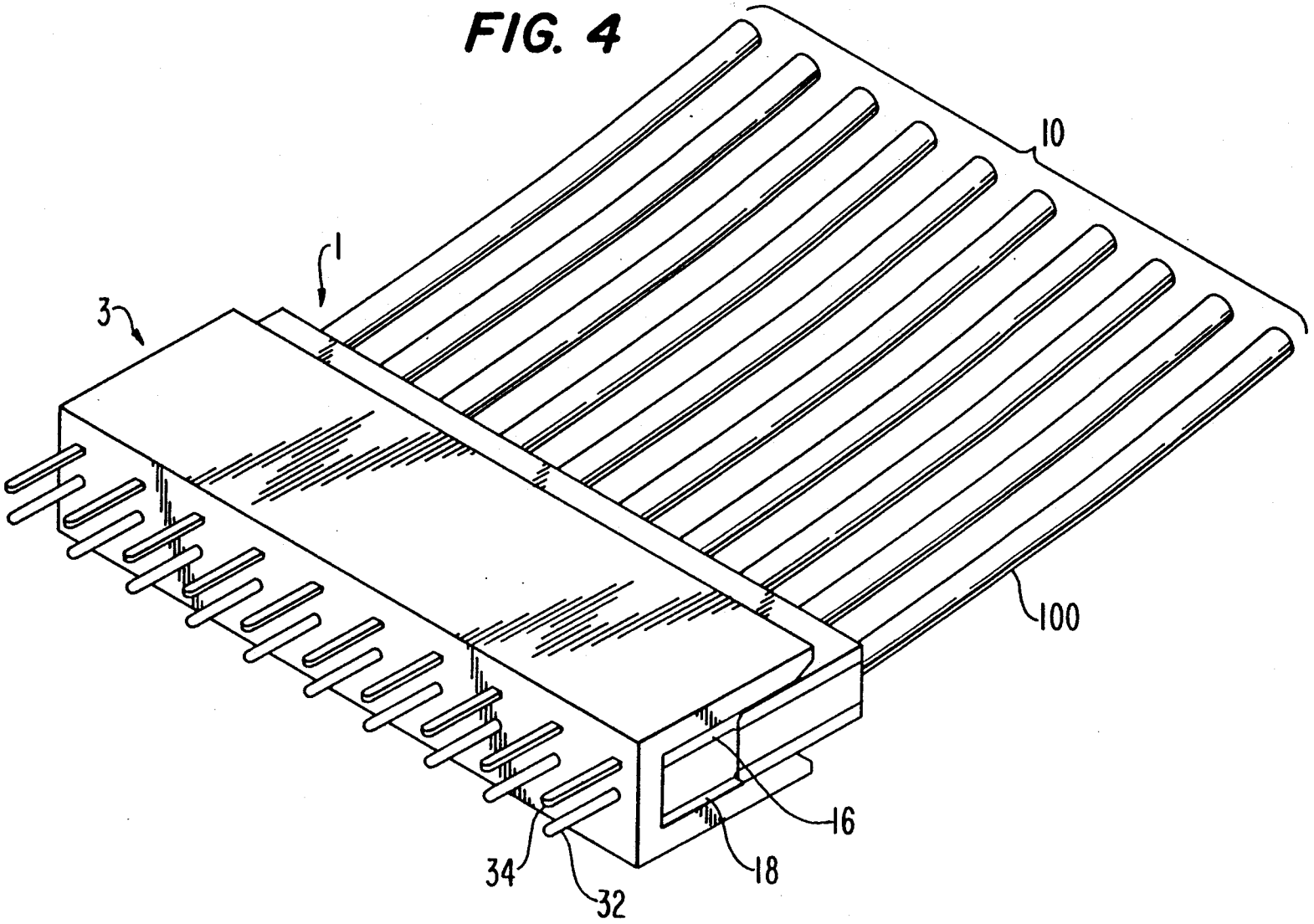
FIG. 4 shows a perspective view of the mated connector parts and a plurality of shielded cables.

A lower half of the grounding shell 18 covers the lower half of the movable connector 1, thus enclosing the signal conductors 104 and socket tails 8. Both parts of the grounding shells 16 and 18 are formed from thin sheet metal and are designed to fit closely around the socket assembly 2 and terminating area of the cable 10 as shown in FIGS. 2 and 4. The parts of the grounding shells 16 and 18 may either fit snugly together or have ends that overlap to prevent separation of the shell parts and to provide electrical continuity between the two halves. Other means for attaching the shell parts together include the use of an adhesive. Cover 19 are also provided to protect the assembled parts.

Also shown in FIG. 1 is an exploded view of the fixed half of the connector also identified as the header 3. The header is further comprised of an insulated housing 30 within which are located at least one row of mating contacts 32. The mating contacts 32 are spaced to fit within sockets 20 of the movable connector part 1. The header is also comprised of at least one row of springy fingers 34 which are spaced to rub against the shell parts.

FIG. 2 shows an assembled movable connector half with the preferred spacing arrangement of sockets 20 which also correspond to the spacing of socket tails 8 (not shown). In the most preferred embodiment the spacing between the centerline of sockets "a" is twice the distance between the socket center and the shell designated by "b". This spacing sacrifices some connector density but causes the electrical fields to be coupled more closely to the shells than to adjacent signal sockets thus reducing cross talk within the connector to levels comparable to those of the shielded cables they are connecting.

Figure 3:
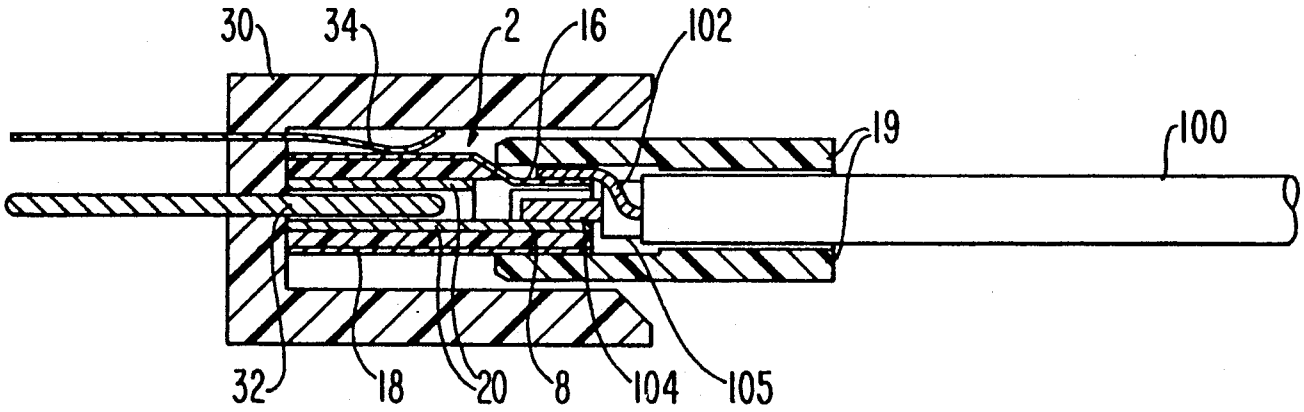
FIG. 3 shows a side view of the fixed connector half and movable connector half with the signal conductor of a shielded cable attached to a signal contact pin and a ground conductor attached to the shell.

FIG. 3 shows a side view of the invention wherein the signal conductor 104 of the shielded cable is attached to a socket tail 8 preferably by means of soldering. The conductor and contact may also be attached by a metal filled adhesive, elastomer or other materials so that electrical conductivity and mechanical integrity are maintained.

Insulation 105 covering the signal conductors 104 of the shielded bundles 100 (shown in FIG. 1) is minimized and is preferably kept to a thickness of approximately 0.01 inch. A preferred insulation material is expanded polytetrafluoroethylene commercially available from H. L. Gore & Associates, Inc.

FIG. 3 also shows the ground conductors 102 of the shielded cable 100 affixed directly to the grounding shell upper half 16 which surrounds the region of attachment between the socket assembly 2 and the plurality of shielded cables 100. The use of this unique grounding configuration allows the socket 20 to be used solely for the signal conductors 104 thus increasing the overall signal capacity of the connector. Additional features of this configuration include the improved electrical signal transmission and easy termination.

The ground conductors 102 are preferably attached to the grounding shell 16 by soldering. Other means for attaching the ground conductors 102 to the grounding shell 16 include spot welding and the use of a conductive adhesive such as metal-filled epoxy or conductive elastomers. The lower half of the ground shell 18 covers the bottom of the conductor-contact joint to fully enclose it and make electrical contact with the upper half of the ground shell 16.

FIG. 3 also shows a springy finger 34 contained within the insulated housing 30 and located above the row of mating contacts 32 of the header 3. The row of springy fingers 34 and row of mating contacts 32 are preferably arranged so that there is a 1 mm space between each row. The springy fingers serve the purpose of electrically and mechanically contacting the ground shell 16 and 18. FIG. 3 shows the mating contact 32 making electrical contact with the socket tail 8.

The insulated housing 30 shown in FIG. 3 is preferably constructed from a thermoplastic and has an overall width of approximately 3 mm.

FIG. 4 shows a perspective of the movable connector part 1, and the fixed connector part 3, fully assembled. The lower part of the ground shell 18 meets with the upper part 16 to fully surround the socket assembly and the region of the cable comprising the signal conductor-contact joint. The shells mate with the springy fingers 34 inside the header 3. The sockets of the socket assembly mate with mating contacts 32 of the header 3.

While the invention has been disclosed herein in connection with certain embodiments and detailed description, it will be clear to one skilled in the art that modifications or variations of such details can be made without deviating from the gist of the invention and such modifications or variations are considered to be within the scope of the claims herein below.

I claim:

1. An electrical connector for a plurality of shielded cables, each shielded cable having at least one insulated signal conductor and at least one ground conductor in contact with a shield which comprises:

(a) a movable connector section, including a socket assembly with a front and back face having at least one row of spaced signal contact sockets with tails accessible to mating contacts from the front face and accessible to shielded cable signal conductors from the rear face; the plurality of signal conductors and ground conductors having a spacing configuration in which said signal conductors are affixed to said socket tails;

(b) an upper and lower shell to which said conductors are affixed enclosing said movable connectors section; and (c) a fixed connector section including an insulated housing containing an array of mating contacts and at least one row of springy fingers wherein said fixed connector section is affixed to said movable connector section by means of connecting said mating contacts to said sockets and said shells to said springy fingers.

2. An electrical connector of claim 1 wherein one ground conductor is positioned adjacent to each signal conductor.

3. An electrical connector of claim 1 wherein said ground conductors are affixed to said shell by soldering means.

4. An electrical connector of claim 1 wherein said ground connectors are affixed to said shell by means of a material selected from the group consisting of electrically conductive adhesives and elastomers.

5. An electrical connector of claim 4 wherein said signal conductors are affixed to said signal contact socket tails by soldering.

6. An electrical connector of claim 4 wherein said signal conductors are affixed to said signal contact socket tails by a material selected from the group consisting of electrically conductive adhesives and elastomers.

7. An electrical connector of claim 1 wherein said fixed connector section has two rows of springy fingers.

8. An electrical connector of claim 1 wherein plastic covers encase shells to provide environmental protection.

9. An electrical connector of claim 1 wherein the socket assembly consists of two rows of regularly spaced socket and signal contact socket tails.

10. An electrical connector of claim 1 wherein the centerline spacing of said sockets is at least twice the distance between the centerline of a socket and the closest point on either of the shells.

* * * * *